United States Patent [19]

Nouno et al.

[11] Patent Number: 4,539,952

[45] Date of Patent: Sep. 10, 1985

[54] SUPPORTING MECHANISM FOR A VALVE SYSTEM OF AN INTERNAL-COMBUSTION ENGINE

[75] Inventors: Yasushi Nouno; Masami Konishi; Yoshio Sasaki, all of Toyota, Japan

[73] Assignee: Toyota Jidosha Kabushiki Kaisha, Toyota, Japan

[21] Appl. No.: 671,508

[22] Filed: Nov. 15, 1984

[30] Foreign Application Priority Data

Nov. 17, 1983 [JP] Japan ..... 58-215041

[51] Int. Cl.[3] ..... F01L 1/20

[52] U.S. Cl. ..... 123/90.36; 123/90.43; 123/90.45; 123/90.27

[58] Field of Search ..... 123/90.36, 90.41, 90.27, 123/90.43, 90.45

[56] References Cited

U.S. PATENT DOCUMENTS

| | | | |
|---|---|---|---|
| 1,902,996 | 3/1933 | Gerard | 123/90.27 |
| 2,145,485 | 1/1939 | Johnson | 123/90.43 |
| 2,564,902 | 8/1951 | Houser et al. | 123/90.45 |
| 3,024,775 | 3/1962 | Wuest | 123/90.45 |
| 3,153,404 | 10/1964 | Van Slooten | 123/90.43 |
| 3,412,717 | 11/1968 | Carey, Jr. et al. | 123/90.45 |
| 3,531,234 | 9/1970 | Ravenel | 123/90.36 |
| 3,563,215 | 2/1971 | Ross | 123/90.42 |
| 4,004,558 | 1/1977 | Scheibe | 123/90.27 |

FOREIGN PATENT DOCUMENTS

| | | |
|---|---|---|
| 875350 | 8/1961 | United Kingdom . |
| 963995 | 7/1964 | United Kingdom . |
| 1051107 | 12/1966 | United Kingdom . |
| 1437567 | 5/1976 | United Kingdom . |

*Primary Examiner*—Ira S. Lazarus

*Attorney, Agent, or Firm*—Kenyon & Kenyon

[57] ABSTRACT

A supporting mechanism for a valve system such as an intake or exhaust valve assembly including a spherical projection provided on a rocker arm and a support member having a downwardly concave support surface which swingably and slidably supports the spherical projection. The support surface has a recess which can hold sludge at a lower portion of the support surface. The recess is communicated with the outer surface of the support member through a hole formed in the support member.

6 Claims, 3 Drawing Figures

SUPPORTING MECHANISM FOR A VALVE SYSTEM OF AN INTERNAL-COMBUSTION ENGINE

BACKGROUND OF THE INVENTION

1. Field of the Invention

The present invention relates to a valve system of an internal-combustion engine, in particular, it relates to an improvement of a support mechanism swingably supporting a rocker arm.

2. Description of the Related Art

Generally, in a valve system such as the above, a spherical projection formed on an adjusting screw provided on a rocker arm is supported by a concave support surface formed on a pivot fixed to a cylinder head, and is in slidable contact with the support surface as the rocker arm swings. Although lubricating oil is supplied between an outer surface of the spherical projection and the support surface, either or both of these surfaces suffer from abrasion because they are in metal-to-metal contact at certain points, and sludge resulting from this abrasion accumulates in the concave support surface. If the amount of accumulated sludge becomes excessive, this sludge will be forced into the areas in which the above two surfaces come in contact with each other, possibly causing abnormal abrasion of those surfaces.

SUMMARY OF THE INVENTION

An object of the present invention is to prevent such abnormal abrasion, caused by the sludge being forced into the areas in which the spherical projection provided on the rocker arm and the concave support surface of the pivot are in metal-to-metal contact.

According to the present invention, a recess for holding sludge is formed on a lower portion of the support surface, the recess being communicated with an outer portion of the support member through a hole formed in the support member.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENT

Figure 1:
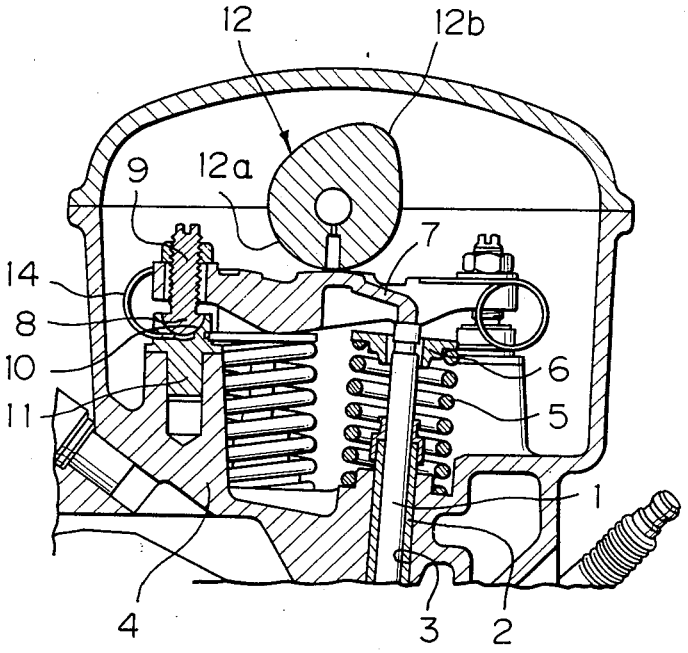
FIG. 1 is a sectional view of a valve system according to an embodiment of the present invention.
Figure 2:
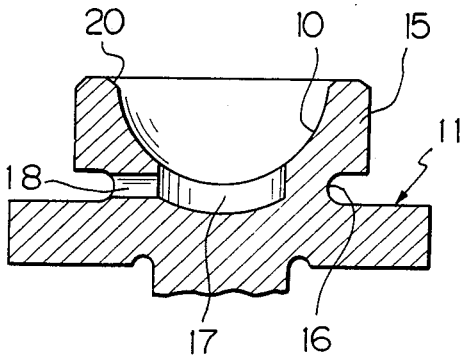
FIG. 2 is an enlarged sectional view of a supporting surface of a pivot.

FIGS. 1 and 2 show an embodiment of the present invention.

Referring to FIG. 1, a valve stem 1 of an intake or exhaust valve is slidably supported by a valve guide 2 fixed in a hole 3 formed in a cylinder head 4. The intake or exhaust valve opens or closes an intake or exhaust port (not shown), respectively, formed in a cylinder. The valve is always urged toward the direction in which the valve closes the port, by a valve spring 5 provided between an upper surface of the cylinder head 4 and a retainer 6 mounted on a top portion of the valve stem 1, and is pushed down by a rocker arm 7 to compress the valve spring 5 and open the port.

The rocker arm 7 is provided with a spherical projection 8 formed on a lower portion of an adjusting screw 9 threadingly mounted on a base portion of the rocker arm 7. The spherical projection 8 is placed on a downwardly concave support surface 10 formed on a pivot 11 fixed on the cylinder head 4, in such a manner that the rocker arm 7 is swingably supported by the pivot 11 about the spherical projection 8. A cam 12 is provided above the rocker arm 7, and the cam 12 is rotated by a camshaft to engage with the upper surface of the rocker arm 7. When a base arc segment **12*a* of the cam 12 is positioned near the rocker arm 7, the valve is urged upwards by the valve spring 5 to close the port. Conversely, when a nose portion 12*b* of the cam 12 engages the rocker arm 7, the valve is pressed down by the rocker arm 7** to open the port.

The rocker arm 7 is held to the pivot 11 by a rocker arm spring 14, in such a manner that the rocker arm 7 will not rotate about its longitudinal axis.

As described above, the rocker arm 7 is swingably supported by the pivot 11. FIG. 2 shows a portion of the support surface 10 of the pivot 11 on an enlarged scale. As can be understood from this figure, the support surface 10 is formed on a cylindrical portion 15 protruding from the upper surface of the pivot 11, and an annular groove 16 is formed in the lower peripheral portion of the cylindrical portion 15. The support surface 10 has a distorted semi-spherical shape, the mouth of which has a larger diameter than that of the outer surface of the spherical projection 8 of the adjusting screw 9, the support surface 10 being in slidable contact with the outer surface of the spherical projection 8 when the swing action of the rocker arm 7 causes the spherical projection 8 to move around on the support surface 10. A recess 17 is formed at a lower portion of the support surface 10. The bottom surface of the recess 17 is formed in an arc shape which has a radius of curvature nearly the same as that of the lower portion of the support surface 10, the center of curvature of the bottom surface of the recess 17 being positioned under the center of curvature of the support surface 10. The recess 17 can temporarily hold sludge stemming from the abrasion between the spherical projection 8 and the support surface 10. The upper periphery 20 of the support surface 10 is chamfered to allow lubrication oil to be conducted between the spherical projection 8 and the support surface 10.

A hole 18 is open to a side wall of the recess 17 and extends in substantially horizontal direction, in such a manner that the recess 17 communicates with the annular groove 16. Therefore, sludge accumulated in the recess 17 is discharged outside of the pivot 11 through the hole 18; and thus, clean lubricating oil is always held between the spherical projection and the support surface, and abnormal abrasion therebetween is prevented.

Figure 3:
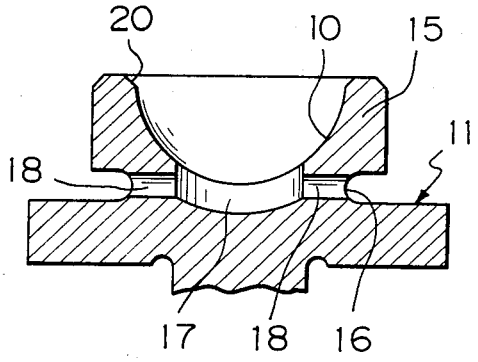
FIG. 3 is an enlarged sectional view of a supporting surface of a pivot in another embodiment of the present invention.

As described above, in the first embodiment, although only one hole 18 is formed in the pivot 11, the number of holes 18 may be increased according to necessity. FIG. 3 shows another embodiment in which the holes 18 are formed on both sides of the recess 17. Note, the dimension of the hole 18 must be such that lubricating oil is always held between the spherical projection 8 and the support surface 10.

Although the embodiments of the present invention have been described herein with reference to the attached drawings, many modifications and changes may be made by those skilled in this art without departing from the scope of the invention.

We claim:

1. In a supporting mechanism for a valve system of an internal-combustion engine, said valve system having a support member provided on a cylinder head of said engine, a rocker arm swingably supported by said support member, an intake or exhaust valve opening or closing a port formed in said cylinder head, and means for swinging said rocker arm so that said valve opens or closes said port, said supporting mechanism comprising said support member having a downwardly concave support surface and an outer surface thereof, a spherical projection provided on said rocker arm and placed on said support surface in such a manner that said spherical surface is in slidable contact with said support surface, and means for connecting said spherical projection to said support member, characterized in that said support member has a recess for holding sludge on a lower portion thereof, said recess being communicated with said outer surface of said support member through a passage formed in said support member so that said sludge is discharged outside of said support member.

2. A supporting mechanism according to claim 1, wherein said support surface is formed on a cylindrical portion protruding from the upper surface of said support member, an annular groove being formed in a lower peripheral portion of said cylindrical portion, a hole being opened between said annular groove and said recess, said hole extending in a substantially horizontal direction and connecting said recess to said annular groove.

3. A supporting mechanism according to claim 1, wherein only one said passage is opened between said recess and the outside of said support member.

4. A supporting mechanism according to claim 1, wherein a plurality of said passages is opened between said recess and the outside of said support member.

5. A supporting mechanism according to claim 1, wherein said support member is a pivot mounted on a cylinder head of said internal-combustion engine.

6. A supporting mechanism according to claim 1, wherein said spherical projection is formed on an adjusting screw threading mounted on a base portion of said rocker arm.

* * * * *